US006131802A

United States Patent [19]

Lombardo

[11] Patent Number: 6,131,802

[45] Date of Patent: Oct. 17, 2000

[54] PRESSURE SEAL FORM

[76] Inventor: Leo Lombardo, 252 Lucas Rd, Manchester, N.H. 03109

[21] Appl. No.: 09/070,515

[22] Filed: Apr. 30, 1998

(Under 37 CFR 1.47)

[51] Int. Cl.[7] ..... B65D 27/16

[52] U.S. Cl. ..... 229/92.1; 462/6

[58] Field of Search ..... 229/92.1, 92.3; 462/6, 900

[56] References Cited

U.S. PATENT DOCUMENTS

| | | | |
|---|---|---|---|
| 4,610,189 | 9/1986 | Lombardo | 83/30 |
| 4,779,792 | 10/1988 | Lombardo | 229/73 |
| 4,809,906 | 3/1989 | Lombardo | 229/73 |
| 4,840,306 | 6/1989 | Lombardo | 229/73 |
| 4,865,247 | 9/1989 | Grabner | 229/92.1 |
| 4,890,788 | 1/1990 | Pennock | 229/71 |
| 4,911,354 | 3/1990 | Lombardo | 229/69 |
| 5,046,661 | 9/1991 | Kimura | 229/92.1 |
| 5,118,030 | 6/1992 | McNamara et al. | 229/69 |
| 5,174,491 | 12/1992 | Taylor et al. | 229/92.1 |
| 5,193,850 | 3/1993 | Lombardo | 281/2 |
| 5,253,798 | 10/1993 | Lombardo | 229/92.1 |
| 5,314,110 | 5/1994 | Lombardo | 229/92.1 |
| 5,318,324 | 6/1994 | Lombardo et al. | 283/62 |
| 5,346,123 | 9/1994 | Lombardo | 229/305 |
| 5,366,146 | 11/1994 | Haan et al. | 229/304 |
| 5,366,410 | 11/1994 | Lombardo | 462/6 |
| 5,376,048 | 12/1994 | Whiteside | 229/92.1 |
| 5,624,069 | 4/1997 | Coats et al. | 229/274 |
| 5,630,899 | 5/1997 | Meschi | 156/217 |
| 5,687,903 | 11/1997 | Akridge et al. | 229/75 |
| 5,785,242 | 7/1998 | Lombardo | 229/305 |
| 5,829,670 | 11/1998 | Lombardo et al. | 229/92.1 |

FOREIGN PATENT DOCUMENTS

WO 98/04420 2/1998 WIPO .

*Primary Examiner*—Stephen P. Garbe

*Attorney, Agent, or Firm*—Fellers, Snider, Blankenship, Bailey & Tippens, P.C.

[57] ABSTRACT

A pressure seal business form including a sheet having a front and a back, top edge, bottom edge, first and second longitudinal edges, at least two panels separated by at least one fold line, longitudinal lines of weakness parallel to the first and second longitudinal edges forming a first and second longitudinal margin portion, horizontal patterns of pressure seal cohesive, and a longitudinal pattern of cohesive positioned in the first and second margin portions defined by at least one individual cohesive configuration. Each individual configuration of cohesive being defined by a first line AB including end points A and B and a second line CD having end points C and D. Line AB and CD are parallel to each other and to the longitudinal edges of the sheet. A third line BD having end points B and D and a fourth line AC having end points A and C. Lines BD and AC are parallel to each other. The angle ABD between lines AB and BD is less than 90°. When the panels of the sheet are folded about the fold lines, the individual configurations defining the longitudinal patterns of cohesive conform and the horizontal patterns of cohesive conform. A pressure seal form is then created by applying external pressure so that the pressure seal cohesive on the conforming patterns adhere and a full perimeter seal is created.

23 Claims, 5 Drawing Sheets

PRESSURE SEAL FORM

BACKGROUND OF THE INVENTION

1. Field of the Invention

This invention relates, generally, to pressure seal systems and cohesive patterns for use with business forms.

2. Background of the Invention

In the business world of today, the use of mailing systems has become a standard practice for many. Such systems include a combination of a variety of activities including folding, enveloping, sealing, metering, inserting, printing, glueing and sorting.

Automation of these processes has saved businesses significant amounts of time, labor and money. As technology has advanced, the equipment and systems used to prepare and distribute mail have become more sophisticated. From a simple postage metering device to the largest, most complex high-speed mail insertion system, the appropriate mailing system is an effective tool for business, enabling virtually any size enterprise to overcome a variety of organizational barriers and impediments.

In the traditional mailing system there was included two or more components to create the mail piece which eventually entered a distribution system such as the Federal Postal Service or an interoffice mail service for deliver to end-users. Typically, the minimum two pieces are the document and an envelope. The document is inserted into the envelope, which is then sealed, metered or stamped and presented to the distribution system.

With the development of self-contained or one part mailing systems, there was eliminated one or more of the components or processes of a traditional mailing system—the document becomes its own envelope, or various plies of a multi-part document serve as outgoing or return envelopes. In the appropriate operations, a self-contained mailing system can provide a level of service, cost-effectiveness and productivity that cannot be matched by larger more traditional systems.

In the beginning, heat seal systems were designed for use with impact printing technologies. For many years, these systems met the needs of and complimented the technology used by businesses around the globe. As technology advanced in the printing and imaging of business documents, a need was created for a one-piece mailing system compatible with a growing variety of non-impact printing devices.

In an effort to meet that need, a variety of products have been developed that would be compatible with the growing numbers of laser printers in the market today.

However, these products have proved to be less friendly and desirable than most customers had wished.

In 1990, a pressure seal system was introduced into the U.S. marketplace. This system was developed to be compatible with both impact and non-impact print/image technologies. Since 1990, the pressure seal system included a variety of form and equipment configurations, which provide a comprehensive offering of document-based information handling solutions.

While seeming a very simple solution to a variety of mail processing issues, the pressure seal system is really quite complex, bringing together a variety of technologies to provide an effective solution.

In a pressure seal system, the glue or cohesive is applied to the form to create the mechanical bonding between adjacent portions of the form. This adhesive (or cohesive) is of a nature which sticks only to itself and then only when subjected to a certain amount of pressure. The properties of the cohesive allow it to be applied to a form at a plant of manufacture, withstand the rigors of being processed through a printer, placing information onto the form, and then sealed generally immediately after printing in order to provide users with a fully integrated mailing system.

A problem, exists however, using pressure seal technology where a multiplicity of forms are stacked, fan-folded or rolled in web form. In such instances, the pressure seal cohesive of one form frequently inadvertently and undesirably sticks (or blocks) to the pressure seal cohesive of an adjacent form. This blocking then frequently causes feeding and paper jam problems when the forms are fed into the printer. A need, therefore, exists for a pressure seal system for use with business forms including a cohesive pattern wherein this blocking problem is reduced or eliminated.

Like any one-piece integrated mailing system a pressure seal system converts a form into a mailable document. In its simplest form, a pressure seal system takes an imaged (printed) document and folds the document and seals the document by applying pressure to the cohesive patterns on the document. The end result of this process is a document ready for franking and mailing.

When sealing the document, security of the contents is of maximum importance. Thus, there is continuously being sought a document form which can be readily used in a pressure seal system while providing a full perimeter seal thus precluding access to the contents of the folded document.

SUMMARY OF THE INVENTION

A pressure seal form of the present invention includes, generally, a sheet having a front and a back, top edge, bottom edge, first and second longitudinal edges, at least two panels separated by a fold line, longitudinal lines of weakness (or perforations) parallel to the first and second longitudinal edges thereby forming a first and second longitudinal margin portion, horizontal patterns of pressure seal cohesive adjacent to the top and bottom edge and at least one longitudinal pattern of cohesive positioned in the first and second margin portion. The pressure seal cohesive being of a nature which sticks only to itself, and then only when subjected to a preset amount of pressure.

Each individual pattern of cohesive being defined by a parallelogram configuration having a first line AB, including end points A and B and second line CD having end points C and D. Lines AB and CD are parallel to each other and to the longitudinal edges of the sheet. A third line BD having end points B and D and a fourth line AC having end points A and C. Lines BD and AC are parallel to each other. The angle ABD between lines AB and BD is less than 90°.

For a pressure seal business form in a V-fold configuration, a first pattern of cohesive formed by a plurality of individual configurations of cohesive disposed in the first and second longitudinal margin portions of the first panel of the sheet. A second longitudinal pattern of cohesive formed by a plurality of individual configurations of cohesive is disposed in the first and second longitudinal margin portions of the second panel of the sheet wherein the second longitudinal pattern of cohesive is a mirror image of the first longitudinal pattern of cohesive. A horizontal pattern of cohesive which may be defined by a plurality of individual configurations of cohesive or a continuous, substantially continuous, or broken strip of pressure cohesive is positioned adjacent the top and bottom edges of the sheet.

When the first and second panels of the sheet are folded about the first fold line, the individual configurations of the longitudinal patterns of cohesive conform and the horizontal patterns of cohesive positioned adjacent the top and bottom edges of the sheet conform. The V-fold pressure seal form is then formed by applying a known amount of external pressure to the form so that the pressure seal cohesive on the conforming patterns adhere and a secure seal between the first and second panel is thereby created.

A second fold line may be added to the sheet thereby creating a third panel. Patterns of cohesive formed by a plurality of individual patterns of cohesive are selectively disposed in the longitudinal margin portions of the face and back of the first, second and third panels such that when the sheet is folded about the first and second fold lines, a Z-fold or C-fold pressure seal business form may be created.

In the Z-fold and C-fold configurations where cohesive is selectively applied to the face and back of the form, the patterns of cohesive formed by the individual cohesive configurations are staggered such that overlap of the individual cohesive configurations is substantially avoided. In this way, blocking (or sticking) of the cohesive in adjacent forms in a stack, fan-fold or roll (web) is substantially eliminated.

Employing a plurality of these individual patterns of cohesive allows one to create a series of business forms providing cohesive sealing around the full perimeter of the form (full perimeter sealing). The opposing individual patterns of cohesive are joined and sealed under pressure enabling the user to create a folded integral mailer of several contemplated configurations for secure mailing applications and/or confidential distribution of information. The forms can be produced cut-sheet or continuous of fan-fold or roll constructions to be processed through either impact or non-impact printing systems. A variety of form sizes are also contemplated which include standard 8½×11 inch and 8½×14 inch forms.

It is thus an object of the present invention to provide a novel cohesive pattern for utilization in a pressure seal system for a business form which provides maximum security by effecting a full perimeter seal. It is a further object of the present invention to provide this novel cohesive pattern to a pressure seal business form which avoids or substantially eliminates blocking between adjacent business forms which might otherwise occur as a result of stacking, fan-folding, or rolling such business forms.

Other aspects, objects and the several advantages of this invention will become apparent from the following detailed description, drawings and appended claims.

DETAILED DESCRIPTION OF THE PREFERRED EMBODIMENT

Figure 1:
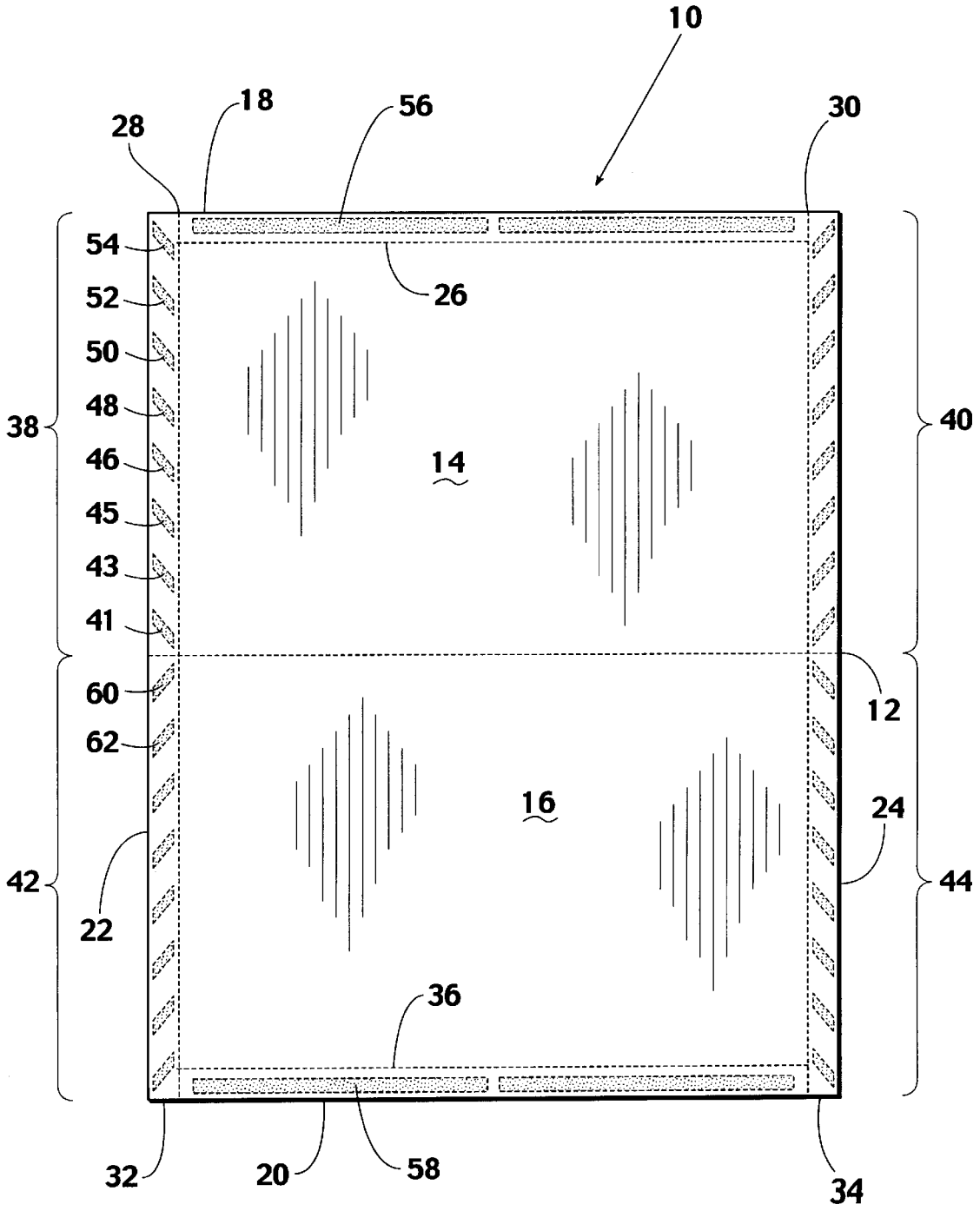
FIG. 1 is a face view of a pressure seal form of the present invention in a V-fold configuration.

In accordance with the present invention, it has been discovered that a business mailer form providing a full perimeter seal for maximized security to the contents of the mailer is achieved when such a form is provided on at least the face thereof a pattern of pressure seal cohesive including individual cohesive configurations of a parallelogram geometry. Referring to FIG. 1, a pressure seal business form 10 in a V-fold configuration is shown. Pressure seal business form 10 consists of a sheet including on its face, a first fold line 12, a first panel 14, and a second panel 16. First panel 14 and second panel 16 are separated by first fold line 12. Pressure seal business form 10 further includes a top edge 18, a bottom edge 20, a first longitudinal edge 22, and a second longitudinal edge 24.

Business forms 10 is comprised of a substantially rectangular sheet. This sheet is paper in the preferred embodiment having a minimum caliper width of 24 lbs. and a maximum of 100 lbs., wherein 24 lb.–28 lb. paper sheets are preferable.

First panel 14 is bounded by first longitudinal edge 22, second longitudinal edge 24 and top edge 18. In a V-fold configuration, the bottom edge of first panel 14, is first fold line 12. First fold line 12 also thereby forms the top edge of second panel 16. Second panel 16 is bounded by first longitudinal edge 22, second longitudinal edge 24 and bottom edge 20.

A first longitudinal line of weakness 28 and a second longitudinal line of weakness 30 are pressed into sheet 10. First and second longitudinal lines of weakness 28 and 30 extend from top edge 18 to bottom edge 20 of sheet 10 and are perpendicular to first fold line 12. First and second longitudinal lines of weakness are perforations of a design known in the industry in the construction of business mailer forms. First fold line 12 is, in the preferred embodiment, a horizontal line of weakness which is a perforation of a type known in the industry in the construction of business forms. First fold line 12 extends between first longitudinal edge 22 and second longitudinal edge 24.

Two additional horizontal lines of weakness 26 and 36 are pressed into the sheet during the construction of business form 10 and are of a type and construction known in the industry. First horizontal line of weakness 26 and second horizontal line of weakness 36 are parallel to but spaced from top edge 18 and bottom edge 20, respectively. First horizontal line of weakness 26 and second horizontal line of weakness 36 extend between first longitudinal line of weakness 28 and second longitudinal line of weakness 30.

First longitudinal line of weakness 28 is parallel to first side edge 22 but spaced therefrom so as to form a first longitudinal margin portion 32. Likewise, second longitudinal line of weakness 30 is parallel but spaced from second side edge 24 so as to define a second longitudinal margin portion 34.

First longitudinal margin portion 32 and second longitudinal margin portion 34 include a first and a second longitudinal pattern of cohesive disposed therein. Each such longitudinal pattern of cohesive is defined by a plurality of individual configurations of cohesive. For example, a first longitudinal pattern of cohesive in first panel 14 includes cohesive pattern 38 which is defined by a plurality of individual cohesive configurations. More particularly, cohesive pattern 38 includes individual cohesive configurations 41, 43, 45, 46, 48, 50, 52, and 54 aligned in the first longitudinal margin portion 32 of first panel 14. In the preferred embodiment, longitudinal pattern of cohesive 38 includes eight such individual configurations of cohesive, however, it is understood that a greater or fewer number or sizes of individual configurations of cohesive are contemplated and may depend on such factors as the length of business from 10.

A second longitudinal pattern of cohesive 42 is defined by a plurality of individual cohesive configurations. A third longitudinal pattern of cohesive 40 and a fourth longitudinal pattern of cohesive 44 are positioned between second edge 24 and second longitudinal line of weakness 30. Third longitudinal pattern of cohesive 40 and fourth longitudinal pattern of cohesive 44 are defined by a plurality of individual cohesive configurations aligned within second longitudinal portion 34.

A first horizontal pattern of cohesive 56 is positioned adjacent top edge 18 between top edge 18 and first horizontal line of weakness 26. First horizontal pattern of cohesive 56 extends between first longitudinal line of weakness 28 and second longitudinal line of weakness 30.

A second horizontal pattern of cohesive 58 is positioned adjacent bottom edge 20 between bottom edge 20 and second horizontal line of weakness 36. Second horizontal pattern of cohesive 58 extends between first longitudinal line of weakness 28 and second longitudinal line of weakness 30.

First and second horizontal patterns of cohesive 56 and 58 are shown in FIG. 1 (preferred embodiment) as a solid line of pressure sensitive cohesive. It is understood, however, that the horizontal patterns of cohesive discussed herein could be a solid line, broken line, or patterned after the first and second longitudinal patterns of cohesive discussed herein.

Cohesive pattern 42 is disposed in the first longitudinal margin portion 32 of second panel 16 and cohesive pattern 44 is disposed within the second longitudinal margin portion 34 of second panel 16. The second longitudinal pattern of cohesive is the mirror image of the first longitudinal pattern of cohesive and the fourth longitudinal pattern of cohesive is the mirror image of the third longitudinal pattern of cohesive wherein each are divided by first fold line 12. For example, cohesive pattern 38 is the mirror image of cohesive pattern 42. Likewise, cohesive pattern 40 is the mirror image of cohesive pattern 44. When the first panel is folded about first fold line 12 over second panel 16, the individual cohesive configurations of the first longitudinal pattern of cohesive and the second longitudinal pattern conform. While the individual cohesive configurations of the third longitudinal pattern of cohesive and the fourth longitudinal pattern of cohesive conform. More particularly, when first panel 14 is folded about first fold line 12 over second panel 16, cohesive pattern 38 conforms to cohesive pattern 42. Specifically, individual cohesive configuration 41 will overlie and conform to individual cohesive pattern 60. Likewise, individual cohesive pattern 43 will overlie and conform to individual cohesive pattern 62, etc. In addition, when first panel 14 is folded about first fold line 12 over second panel 16, first horizontal pattern of cohesive 56 will overlie and conform to second horizontal pattern of cohesive 58.

In use, once first panel 14 is folded about first fold line 12 over second panel 16, business form 10 is subjected to pressure thereby adhering the pressure seal cohesive in the first longitudinal pattern of cohesive to the cohesive in the second longitudinal pattern of cohesive and the first horizontal pattern of cohesive 56 adheres to the second horizontal pattern of cohesive 58 thereby forming a secure seal around the perimeter of business form 10. This adhesion thereby defines a full perimeter seal.

Figure 3:
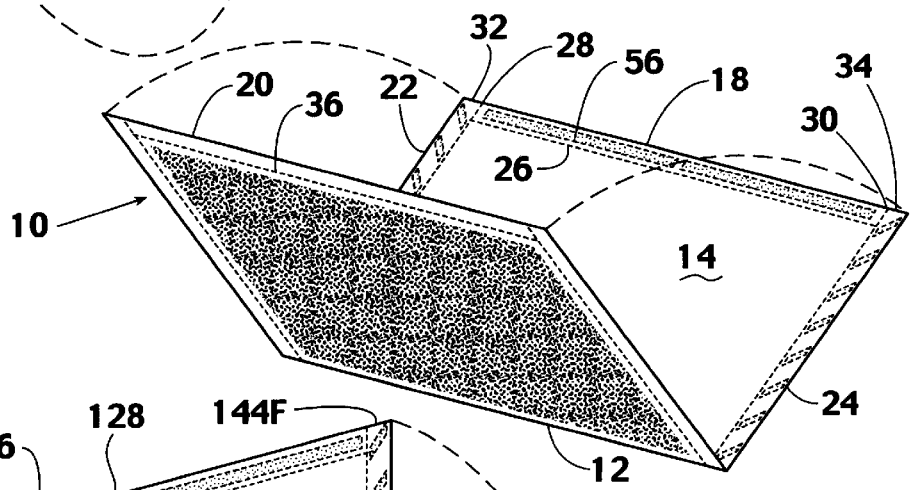
FIG. 3 is an isometric view of the V-fold pressure seal form of FIG. 1 wherein the first and second panels are shown folded about the first fold line.

Referring next to FIG. 3, business form 10 in a V-fold configuration is shown folded about first fold line 12 wherein first panel 14 and second panel 16 will contact forming a V-fold pressure seal business form.

Figure 2:
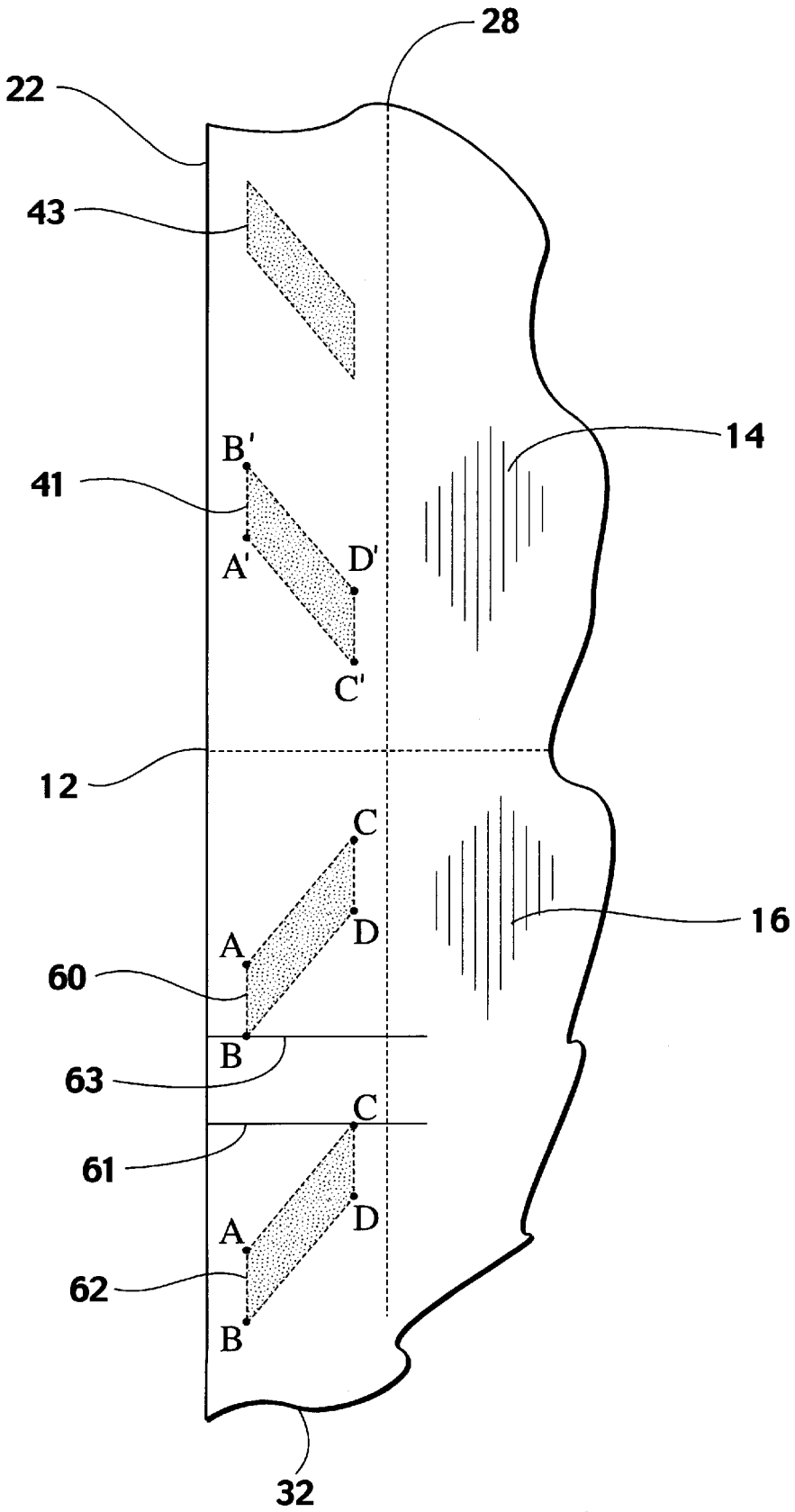
FIG. 2 is an enlarged section of the form of FIG. 1 showing the longitudinal patterns of cohesive disposed in the first longitudinal margin portions in the first and second panels.

Attention is next directed to FIG. 2 which depicts an enlarged partial section of first panel 14 and second panel 16 divided by first fold line 12 and also depicting first longitudinal margin portion 32, individual cohesive configurations 41 and 43 of the first longitudinal pattern of cohesive and individual cohesive configurations 60 and 62 of the second longitudinal pattern of cohesive.

Each individual configuration of cohesive is defined in a parallelogram geometry. As can be seen, cohesive configuration 60 is defined by a line AB between points A and B, a line CD between points C and D, a line AC between points A and C and a line BD between points B and D. Lines AB and BD form angle ABD which is less than 90°. This individual configuration of cohesive provides a important secure seal along edges 22 and 24 (of FIG. 1). This arrangement of individual configurations, as described herein, has been found to effect a secure full perimeter seal around business form 10. In addition, it has been found that the alignment of these individual cohesive configurations of the first and second longitudinal patterns of cohesive reduces or eliminates the problem of curling of the form when the cohesive is applied and dried. Such curling is a known problem (especially in the case of the Z-fold and C-fold forms discussed below) when cohesive is applied along the grain of the paper.

A further important effect of a longitudinal pattern of the above individual cohesive configurations is that when a plurality of pressure seal business forms of the present invention are stacked or in fan-fold configuration, the individual cohesive configurations may be aligned in a staggered, alternating arrangement where the pressure seal cohesive on the back of one form may otherwise contact the pressure seal cohesive on the face of an underlying form (as with a Z-fold or C-fold configuration, discussed below). Such contact between the pressure seal cohesive on adjacent forms has been known to cause the cohesive to block (or stick) due to the pressure placed on the adjacent forms by the weight of the stack or fan-fold. This blocking is known to cause paper feed tam) problems when the forms from the stack or fan-fold are fed into a printer. With the use of the cohesive pattern disclosed herein, such contact (and resultant blocking) may be substantially eliminated.

A pressure seal business form of the present invention has been constructed in the V-fold, Z-fold and C-fold configurations using both 8½×11 inch and 8½×14 inch sheets. The resultant business forms each include a first and second longitudinal margin portion having a width of about ⅜ inches and a width of each panel of about 7¾ inches. Each individual pattern of cohesive wherein the lengths of lines AB and CD are about 3/16 inches; the lengths of lines AC and BD are about ⅜ inches; the distance between point A on one individual cohesive configuration (62 of FIG. 2) and point B on the next individual configuration (60 of FIG. 2) is ½ inch; the distance between point C on one individual cohesive configuration (62 of FIG. 2) and point D on the next individual cohesive configuration is ½ inch; the distance between a line (61 of FIG. 2) between the first longitudinal edge (22 of FIG. 2) and the first longitudinal line of weakness (28 of FIG. 2) through point C of one individual configuration of cohesive (62 of FIG. 2) and a line (63 of FIG. 2) between the first longitudinal edge (22 of FIG. 2) and the first longitudinal line of weakness (28 of FIG. 2) through point B of the next individual configuration of cohesive (60 of FIG. 2) is about ¼ inch.

Figure 5:
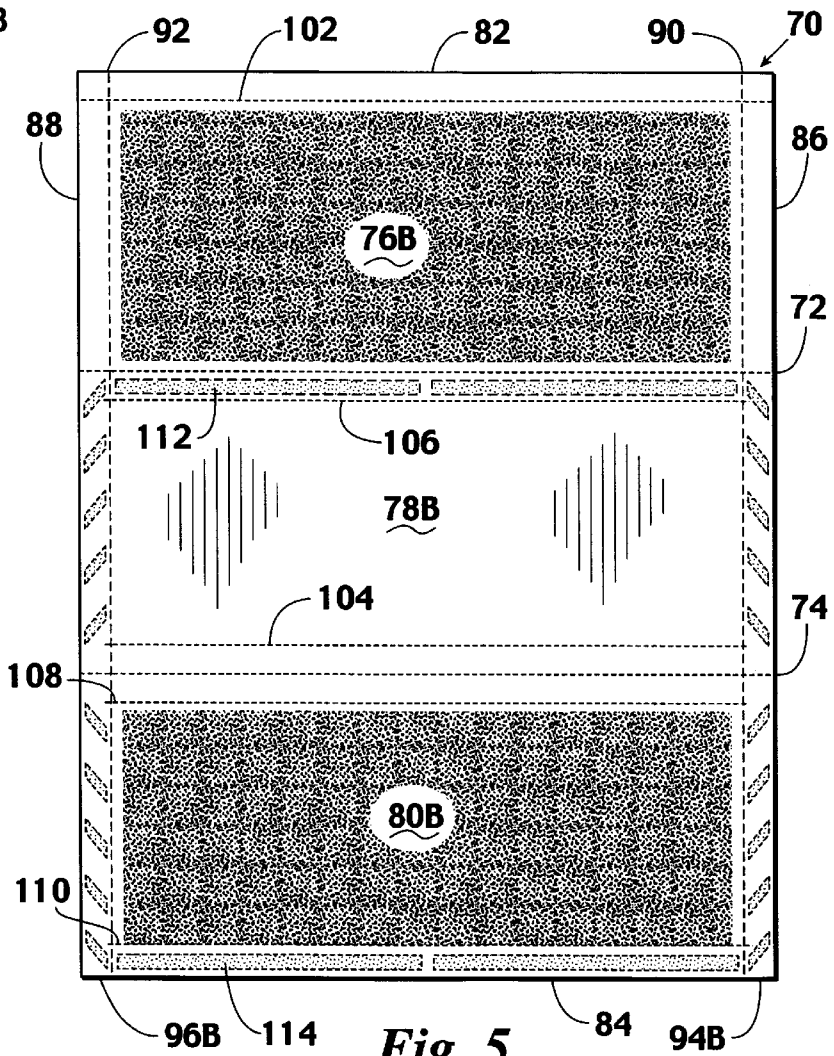
FIG. 5 is a view of the back of the pressure seal form of the present invention in a Z-fold configuration.
Figure 4:
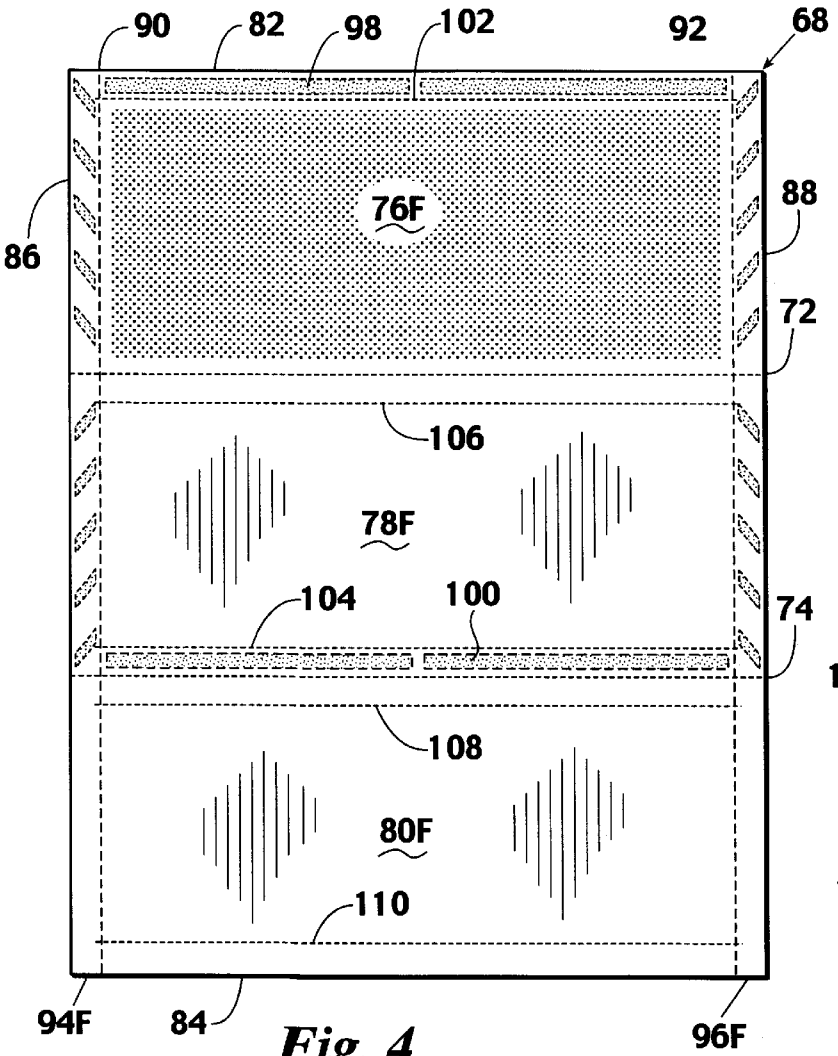
FIG. 4 is a view of the face of the pressure seal form of the present invention in a Z-fold configuration.

FIGS. 4 and 5 depict the pressure seal business form of the present invention in a Z-fold configuration. FIG. 4 depicts the face 68 of the pressure seal business form in the Z-fold configuration while FIG. 5 depicts the back 70. Face 68 of FIG. 4 includes a first fold line 72 and a second fold line 74. First fold line 72 separates first panel from the second panel, while second fold line 74 separates the second panel from the third panel. First fold line 72 is parallel and spaced from second fold line 74. Fold lines 72 and 74 are lines of weakness (perforations) in the preferred embodiment, however, it is understood that fold lines 72 and 74 could be other configurations, such as creases or indicia on the sheet.

For purposes of simplification herein, the numerals identifying the first, second and third panels and longitudinal margin portions on the face will be identified with an "F", while the first, second and third panels and longitudinal margin portions on the back 70 will be identified with "B". As such, first fold line 72 separates first panel 76F from second panel 78F, while second fold line 74 separates second panel 78F and third panel 80F.

The Z-fold configuration sheet includes a top edge 82, a bottom edge 84, a first longitudinal side edge 86 and an opposite longitudinal side edge 88. First longitudinal edge 86 and second longitudinal edge 88 are perpendicular to the first fold line 72 and the second fold line 74. A first longitudinal line of weakness 90 is pressed into the sheet parallel to but spaced from longitudinal side edge 86. A first longitudinal margin portion 94F is formed between first longitudinal edge 86 and first longitudinal line of weakness 90.

A second longitudinal line of weakness 92 is pressed into the Z-fold sheet parallel to but spaced from the second longitudinal edge 88. A second longitudinal margin portion 96F is formed between second edge 88 and second longitudinal line of weakness 92.

First longitudinal line of weakness 90 and second longitudinal line of weakness 92 extend from top edge 82 to bottom edge 84. A first longitudinal pattern of cohesive is disposed in the first longitudinal margin portion of first panel 76F. A fifth longitudinal pattern of cohesive is disposed in the second longitudinal margin portion of first panel 76F. This first and fifth longitudinal pattern of cohesive is defined by a plurality of individual configurations of cohesive.

A second longitudinal pattern of cohesive is disposed within the first portion 94F of second panel 78F. The second longitudinal pattern of cohesive is defined by a plurality of individual configurations of cohesive aligned within first longitudinal margin portion 94F of panel 78F.

A sixth longitudinal pattern of cohesive is disposed within the second longitudinal margin portion 96F of second panel 78F. The sixth longitudinal pattern of cohesive is defined by a plurality of individual configurations of cohesive aligned within second longitudinal margin portion 96F of the panel 78F.

The first longitudinal pattern of cohesive is the mirror image of the second longitudinal pattern of cohesive divided by first fold line 72 likewise, the fifth longitudinal pattern of cohesive is the mirror image of the sixth longitudinal pattern of cohesive divided by first fold line 72.

In a Z-fold pressure seal business form, preferred embodiment, there are no longitudinal patterns of cohesive disposed in the first and second longitudinal margin portions 94F and 96F of third panel 80F.

A first horizontal pattern of cohesive 98 is positioned adjacent top edge 82 between top edge 82 and a first horizontal line of weakness 102. First horizontal pattern of cohesive 98 and first horizontal line of weakness 102 extend between first longitudinal line of weakness 90 and second longitudinal line of weakness 92.

A second horizontal pattern of cohesive 100 is positioned adjacent second fold line 74 between second fold line 74 and a second horizontal line of weakness 104. A third horizontal line of weakness 106 is positioned parallel to but spaced from first fold line 72 in second panel 78F. However, in the Z-fold preferred embodiment there is no horizontal pattern of cohesive disposed between first fold line 72 and third horizontal line of weakness 106.

A fourth horizontal line of weakness 108 is pressed in the Z-fold sheet parallel to but spaced from second fold line 74 within third panel 80F. However, there is no horizontal pattern of cohesive disposed between second fold line 74 and fourth horizontal pattern of weakness 108 in a Z-fold configuration preferred embodiment. However, it is understood that such horizontal cohesive configurations could be supplied as desired or required by a particular application.

Referring next to FIG. 5, attention is directed to the back 70 of the Z-fold sheet. On back 70, first fold line 72 separates first panel 76B and second panel 78B, while second fold line 74 separates second panel 78B and third panel 80B.

First longitudinal margin portion 94B is defined between first longitudinal edge 86 and first longitudinal line of weakness 90. Second longitudinal margin portion 96B is defined between second longitudinal edge 88 and second longitudinal line of weakness 92.

A third longitudinal pattern of cohesive is disposed within first longitudinal margin portion 94B of second panel 78B. The third longitudinal pattern of cohesive is defined by a plurality of individual configurations of cohesive aligned along first longitudinal margin portion 94B in second panel 78B. In the preferred embodiment, as can be seen in FIGS. 4 and 5, third longitudinal pattern of cohesive is substantially the same as the second longitudinal pattern of cohesive. The alignment of individual cohesive configurations of the third longitudinal pattern of cohesive will be directed away from, or offset from, those defining the second longitudinal pattern of cohesive in a stacked or fan-fold arrangement of forms (8½×11 inch) since the third longitudinal pattern of cohesive on the back of one form will overlie the second longitudinal pattern of cohesive on the face of the adjacent form. This is because the same pattern of cohesive will traverse when the same pattern of cohesive is turned over on itself.

A seventh longitudinal pattern of cohesive is disposed with second longitudinal margin portion 96B of second panel 78B. This seventh longitudinal pattern of cohesive is defined by a plurality of individual configurations of cohesive aligned along second longitudinal margin portion 96B of second panel 78B.

A fourth longitudinal pattern of cohesive is disposed within first longitudinal margin portion 94B in third panel 80B. The fourth longitudinal pattern of cohesive is defined by a plurality of individual configurations of cohesive aligned along first longitudinal margin portion 94B of third panel 80B. In the preferred embodiment Z-fold, since the second and third longitudinal patterns of cohesive are substantially the same, the first and the fourth longitudinal patterns of cohesive will be the same because the first longitudinal pattern of cohesive is the mirror image of the second and the fourth longitudinal pattern of cohesive is the mirror image of the third.

An eighth longitudinal pattern of cohesive is disposed within second longitudinal margin portion 96B in third panel 80B. The eight longitudinal pattern of cohesive is defined by a plurality of individual configurations of cohesive aligned along second longitudinal margin portion 96B of third panel 80B.

The third longitudinal pattern of cohesive is a mirror image of the fourth longitudinal pattern of cohesive. The seventh longitudinal pattern of cohesive is a mirror image of the eighth longitudinal pattern of cohesive.

A third horizontal pattern of cohesive 112 is positioned adjacent first fold line 72 between first fold line 72 and third horizontal line of weakness 106. A fourth horizontal pattern of cohesive 114 is positioned adjacent bottom edge 84 between bottom edge 84 and fifth horizontal line of weakness 110. There is no horizontal pattern of cohesive positioned between second horizontal line of weakness 104 and second fold line 74 nor is there a horizontal pattern of cohesive positioned between second fold line 74 and fourth horizontal line of weakness 108 in the Z-fold configuration preferred embodiment. Horizontal lines of weakness 102, 104, 106, and 108 are designed to be torn away so as to provide access to the information included on the Z-fold business form when the sheet is folded in a Z-fold configuration and full perimeter sealing is effected.

As can be seen in FIGS. 4 and 5, shading patterns may be provided on selected panels, such as 76F, 76B, and 80B in order to conceal information printed on the business form. Such shading patterns, referred to in the industry as a Chinese blockout, are known to be used on integral business forms.

Figure 6:
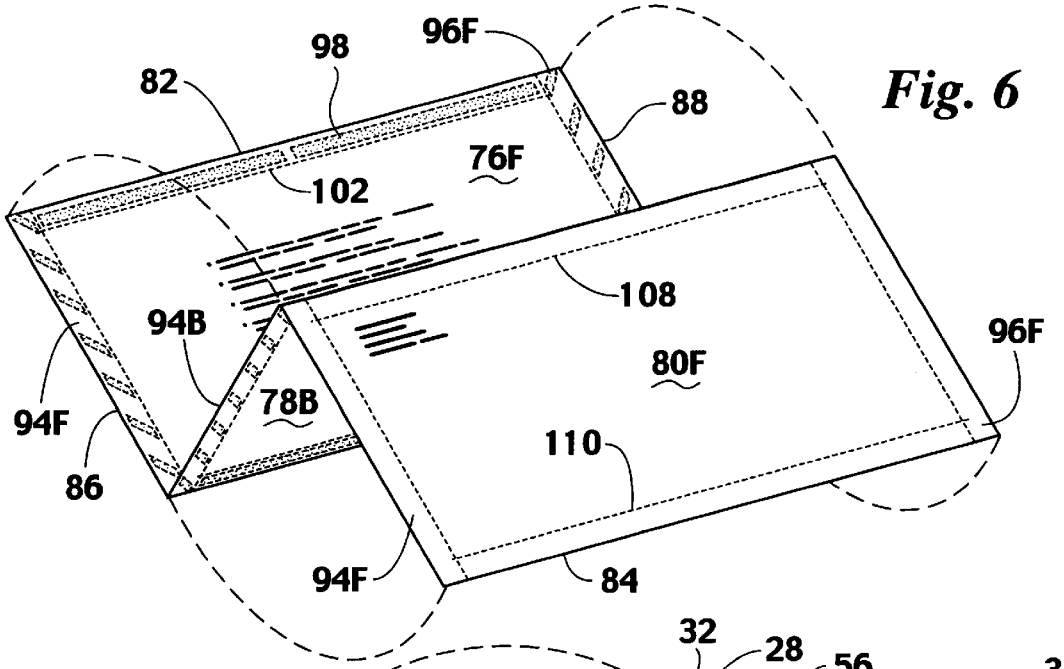
FIG. 6 is an isometric view of the pressure seal form of the present invention in a Z-fold configuration wherein the first and second panels are shown folded about the first fold line and the second and third panels are shown folded about the second fold line to form a Z-fold business form.

Reference is next made to FIGS. 4 and 5 in combination with FIG. 6. In use, first panel 76F is folded about first fold line 72 such that face 76F comes in contact with the face of second panel 78F. When the face of first panel 76F is folded about first fold line 72 onto the face of second panel 78F, the individual configurations defining the first and second longitudinal patterns of cohesive conform. Likewise, the first 98 and second 100 horizontal patterns of cohesive conform.

Once the face of first panel 76F is folded about first fold line 72 over the face of second panel 78F, the back of third panel 80B is folded about second fold line 74 over the back of second panel 78B. Accordingly, the individual configurations of the third and fourth longitudinal patterns of cohesive conform and the third and fourth horizontal patterns of cohesive 112 and 114 conform.

Once the face of first panel 76F is folded about first fold line 72 over the face of second panel 78F and the back of third panel 80B is folded about second fold line 84 over the back of second panel 78B, the Z-fold business form is subjected to a known external pressure thereby adhering the pressure seal cohesive of the individual cohesive configurations defining the first longitudinal pattern of cohesive adheres to the individual cohesive configurations defining the second longitudinal pattern of cohesive, and the individual cohesive configurations defining the third longitudinal pattern of cohesive adhere to the individual cohesive configurations defining the fourth longitudinal pattern of cohesive. Likewise, the first horizontal pattern of cohesive 98 adheres to the second horizontal pattern of cohesive 100 and the third horizontal pattern of cohesive 112 adheres to the fourth horizontal pattern of cohesive 114.

As discussed above, the manner in which the business form in the Z-fold configuration is folded about first fold lines 72 and second fold line 74 is depicted in FIG. 6.

Figure 8:
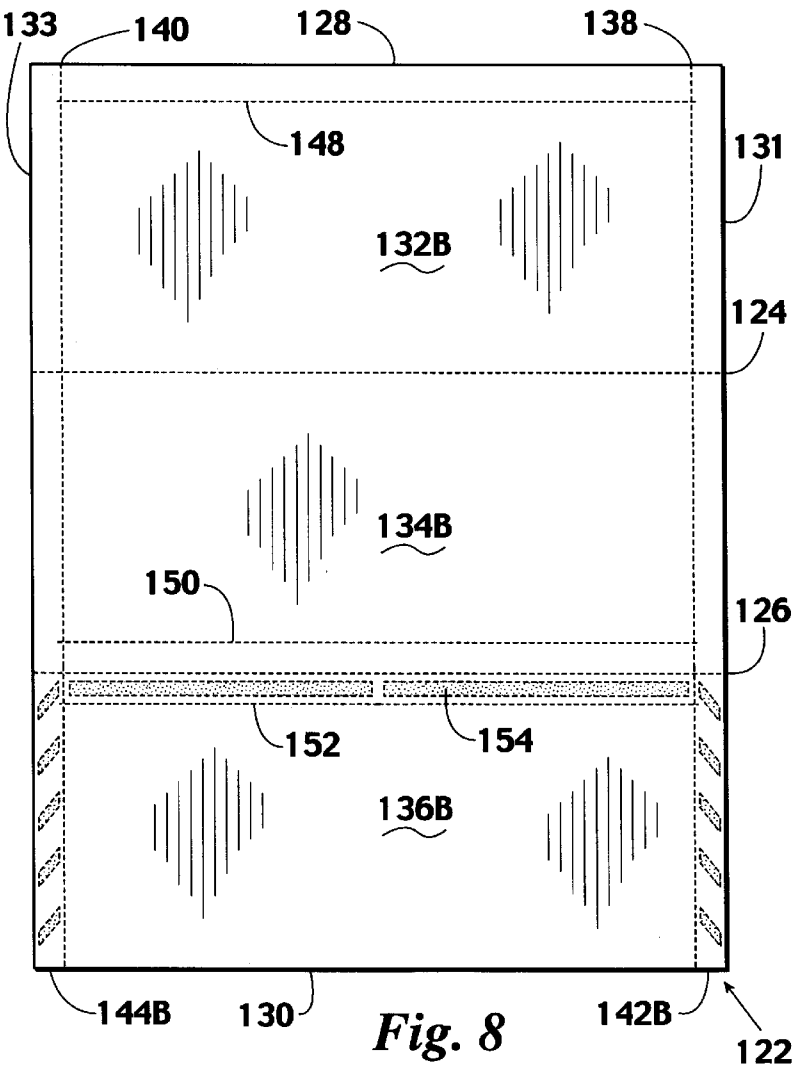
FIG. 8 depicts the back of a pressure seal form of the present invention in a C-fold configuration.
Figure 7:
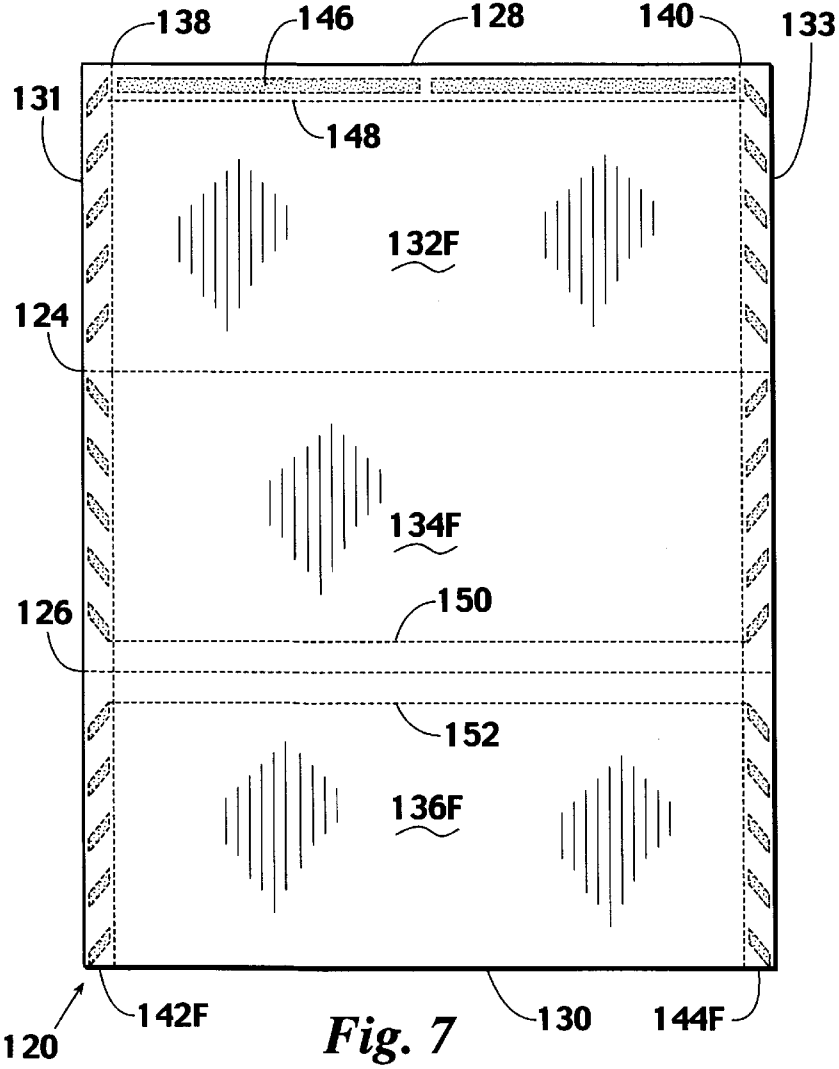
FIG. 7 shows the face of a pressure seal form of the present invention in a C-fold configuration.

Attention is next directed to FIGS. 7 and 8 which depict the pressure seal business form of the present invention configured in a C-fold configuration. FIG. 7 depicts the face 120 and FIG. 8 depicts the back 122 of the C-fold sheet. The C-fold sheet of FIGS. 7 and 8 includes a first fold line 124 and a second fold line 126. The C-fold sheet further includes a top edge 128, a bottom edge 130, a first longitudinal edge 131 and a second longitudinal edge 133.

Referring particularly to FIG. 7 showing face 120, first fold line 124 separates a first panel 132F and a second panel 134F. Second fold line 126 separates second panel 134F and third panel 136F. A first longitudinal line of weakness 138 is pressed in the sheet parallel to but spaced from first longitudinal edge 131 thereby defining a first longitudinal margin portion 142F. A second longitudinal line of weakness 140 is pressed into the sheet parallel to but spaced from second longitudinal edge 133 thereby defining a second longitudinal margin portion 144F.

A first longitudinal pattern of cohesive is disposed in the first longitudinal margin portion 142F of first panel 132F. The first longitudinal pattern of cohesive is defined by a plurality of individual configurations of cohesive aligned along first longitudinal margin portion 142F in first panel 132F.

A second longitudinal pattern of cohesive is defined in the first longitudinal margin portion 142F of second panel 134F. The second longitudinal pattern of cohesive is defined by a plurality of individual configurations of cohesive aligned along the first longitudinal margin portion 142F of second panel 134F. The first longitudinal pattern of cohesive is a mirror image of the second longitudinal pattern of cohesive separated by first fold line 124.

A third longitudinal pattern of cohesive is defined in the second longitudinal margin portion 144F of first panel 132F. The third longitudinal pattern of cohesive is defined by a plurality of individual configurations of cohesive aligned along second longitudinal margin portion 144F in first panel 132F. A fourth longitudinal pattern of cohesive is defined in the second longitudinal margin portion 144F of second panel 134F. The fourth longitudinal pattern of cohesive is defined by a plurality of individual configurations of cohesive aligned along second longitudinal margin portion 144F in second panel 134F.

A fifth-longitudinal pattern of cohesive is disposed within the first longitudinal margin portion 142F of third panel 136F. The fifth longitudinal pattern of cohesive is defined by a plurality of individual configurations of cohesive aligned along first longitudinal margin portion 142F of third panel 136F. The second longitudinal pattern of cohesive disposed in the second panel 134 is the mirror image of the fifth longitudinal pattern of cohesive disposed in the third panel 136F separated by the second fold line 126.

A seventh longitudinal pattern of cohesive is defined within the second longitudinal margin portion 144F of third panel 136F. The seventh longitudinal pattern of cohesive is defined by a plurality of individual configurations of cohesive aligned along second longitudinal margin portion 144F of third panel 136F.

A first horizontal pattern of cohesive 146 is positioned adjacent top edge 128 between top edge 128 and a first horizontal line of weakness 148. Horizontal pattern of cohesive 146 and first horizontal line of weakness 148 extend between first longitudinal line of weakness 138 and second longitudinal line of weakness 140.

A second horizontal line of weakness 150 is pressed into second panel 134F parallel to but spaced from second fold line 126 and extends between first longitudinal line of weakness 138 and second longitudinal line of weakness 140 within second panel 134F. In the C-fold configuration, preferred embodiment, there is no horizontal pattern of cohesive positioned disposed between second fold line 126 and second horizontal line of weakness 150.

A third horizontal line of weakness 152 is pressed into third panel 136F parallel to but spaced from second fold line 126. Third horizontal line of weakness 152 extends between first longitudinal line of weakness 138 and second longitudinal line of weakness 140 within third panel 136F. In the preferred embodiment of a C-fold configuration, there is no horizontal pattern of cohesive disposed between second fold line 126 and third horizontal line of weakness 152.

Reference is next made to FIG. 8 depicting back 122 of the C-fold sheet.

A sixth longitudinal pattern of cohesive is disposed in the first 142B of the back of third panel 136B. The sixth longitudinal pattern of cohesive is defined by a plurality of individual configurations of cohesive aligned along first longitudinal margin portion 142 of the back of third panel 136B.

An eighth longitudinal pattern of cohesive is defined within the second longitudinal margin portion 144B of third panel 136B. The eighth longitudinal pattern of cohesive is defined by a plurality of individual configurations of cohesive aligned along second longitudinal margin portion 144B of third panel 136B.

A second horizontal pattern of cohesive is positioned adjacent the second fold line 126 between second fold line 126 and third horizontal line of weakness 152 on the back of third pattern 136B. The second horizontal pattern of cohesive 154 and third longitudinal line of weakness 152 extend between first longitudinal line of weakness 138 and second longitudinal line of weakness 140 on the back of the third panel 136B.

There is no horizontal pattern of cohesive disposed between top edge 128 and first horizontal line of weakness 148 on the back of first panel 132B in the preferred embodiment. Likewise, there is no horizontal pattern of cohesive disposed between second fold line 126 and second horizontal line of weakness 150 on the back of second panel 134B in the preferred embodiment. Horizontal lines of weakness 148, 150, and 152 are provided for the user to tear the folded C-fold business form along the respective horizontal lines of weakness in order to access the information contained on the C-fold business form. In this way, the user is spared the task of separating the engaged cohesive patterns.

Figure 9:
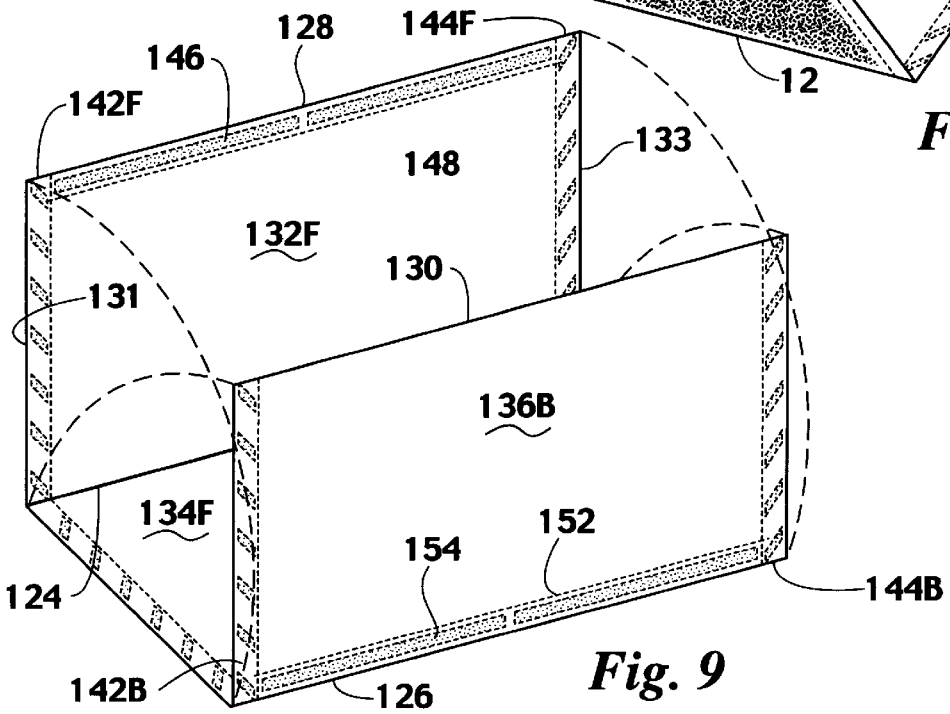
FIG. 9 is an isometric view of the pressure seal form of the present invention wherein the first and second panels are shown folded about the first fold line and the second and third panels are shown folded about the second fold line to form a C-fold business form.

In use, referring to FIGS. 7 and 8 in combination with FIG. 9, the C-fold business form is provided by folding the front of third panel 136F about second fold line 126 in contact with the front of second panel 134F. When the front of third panel 136F is folded about second fold line 126 over the front of second panel 134F, the individual configurations of cohesive defining the second and fifth longitudinal patterns of cohesive conform. Accordingly, the individual configurations of cohesive defining the fourth and seventh longitudinal patterns of cohesive conform.

Once the face of third panel 136F is folded about second fold line 126 over the face of second panel 134F, the face of first panel 132F is folded about first fold line 124 onto the back of third panel 136F. When the face of first panel 132F is folded about first fold line 124 over the back of third panel 136B, the individual configurations defining the first and sixth longitudinal patterns of cohesive conform. Also the individual configurations defining the third and eighth longitudinal patterns of cohesive conform. In addition, the first and fifth horizontal patterns of cohesive conform.

When the C-fold pressure seal business form is folded as described above, the business form is subjected to a known pressure thereby adhering the pressure seal cohesive of the individual cohesive configurations defining the fifth and seventh longitudinal pattern of cohesive adhere to the individual cohesive configurations of the second and fourth longitudinal pattern of cohesive, respectively, while the individual configurations of cohesive in the first and third longitudinal pattern of cohesive adhere to the individual configurations of the sixth and eighth longitudinal pattern of cohesive, respectively. Likewise, the first horizontal pattern of cohesive adheres to the second horizontal pattern of cohesive. Thus, a C-fold pressure seal business form is defined.

The sixth longitudinal pattern of cohesive in the preferred embodiment is substantially the same as the fifth longitudinal pattern of cohesive and the seventh longitudinal pattern of cohesive is substantially the same as the eighth longitudinal pattern of cohesive. This is because when the business forms are stacked or in a fan-fold arrangement, the back of one form will contact the face of the underlying form. In this manner, the sixth longitudinal pattern of cohesive will contact the seventh longitudinal pattern of cohesive while the eighth longitudinal pattern of cohesive will contact the fifth longitudinal pattern of cohesive on the underlying form. Since the patterns of cohesive are the same, laying the back of one sheet over the face of another will result in a reversal of the patterns of cohesive. This reversal substantially eliminates contact between the individual cohesive configurations defining the sixth and eighth longitudinal pattern of cohesive and the individual cohesive configurations defining the underlying seventh and fifth longitudinal patterns of cohesive, respectively.

The fifth and sixth longitudinal patterns of cohesive are also substantially the same as the first longitudinal pattern of cohesive while the seventh and eighth longitudinal patterns of cohesive are substantially the same as the third longitudinal pattern of cohesive. This is because when the face of third panel 136F is folded over the face of the second panel 134F in a C-fold form, bottom edge 130 is folded back toward top edge 128 revealing the back of third panel 136F. If the sixth longitudinal pattern of cohesive is substantially the same as the first longitudinal pattern of cohesive in this folded position, the sixth longitudinal pattern of adhesive will be the mirror image of the first longitudinal pattern of cohesive divided by bottom edge 130 or first fold line 124 underlying bottom edge 130. The same is true for the eighth and third longitudinal patterns of cohesive. This mirror image is required in order to complete the C-fold form as described above.

As discussed above, FIG. 9 depicts the pressure seal business form of the present invention as configured in a C-fold form.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A V-fold pressure seal form, comprising:

a sheet having a face, a back, at least one first fold line, a first panel and a second panel separated by said first fold line, each panel having a top edge, a bottom edge, a first side edge and a second side edge;

said sheet having first and second opposite longitudinal edges perpendicular to said first fold line;

first and second longitudinal lines of weakness formed in said sheet parallel to and adjacent, but spaced from said first and second longitudinal edges, respectively, said lines of weakness defining with said longitudinal edges a first and a second longitudinal margin portion in each panel;

a first horizontal pattern of cohesive parallel and adjacent to said top edge on the face of said first panel;

a second horizontal pattern of cohesive parallel and adjacent to said bottom edge on the face of said second panel;

a first longitudinal pattern of cohesive disposed in said first longitudinal margin portions in said first panel;

said first longitudinal pattern of cohesive having individual configurations, each configuration having a first line AB having end points A and B and a second line CD parallel to said first line and having end points C and D, said lines are parallel to said longitudinal edges;

a third line BD having end points B and D which makes an angle ABD with said first line which is less than 90 degrees;

a fourth line AC having end points A and C;

a second longitudinal pattern of cohesive disposed in the first longitudinal margin portion in said second panel, said longitudinal pattern being a mirror image of the first longitudinal pattern such that when the first and second panels are folded about said fold line the individual configurations of said longitudinal patterns of cohesive conform and the first horizontal pattern of cohesive and the second horizontal pattern of cohesive conform.

2. A pressure seal form as defined in claim 1 wherein neither end point C or D lies on a line through end point B which line is perpendicular to said first and second longitudinal edge of said sheet.

3. A pressure seal form as defined in claim 1 wherein fourth line AC and said third line BD are straight and are parallel.

4. A pressure seal form as defined in claim 1 wherein the width of each longitudinal margin portion is about ⅜ inches; the length of said first line AB and length of said second line CD is about ⅜ inches; the length of third line BD and the length of fourth AC is about 3/16 inches.

5. A pressure seal form as defined in claim 1, including:

a first horizontal line of weakness positioned parallel to but spaced from said top edge in said first panel;

said first horizontal pattern of cohesive being disposed between said top edge and said first horizontal line of weakness;

a second horizontal line of weakness positioned parallel to but spaced from said bottom edge of said second panel;

said second horizontal pattern of cohesive being disposed between said bottom edge and said second horizontal line of weakness.

6. A pressure seal form as defined in claim 5 wherein said first fold line is a line of weakness.

7. A pressure seal form as defined in claim 6 wherein said lines of weakness are perforations.

8. A Z-fold pressure seal form, comprising:

a sheet having a face, a back, a first fold line, a first panel and a second panel separated by said first fold line, a second fold line, and a third panel wherein said second panel and said third panel are separated by said second fold line;

each panel having a top edge, a bottom edge, a first side edge and a second side edge;

said sheet having first and second opposite longitudinal edges perpendicular to said first fold line;

first and second longitudinal lines of weakness formed in said sheet parallel to and adjacent, but spaced from said first and second longitudinal edges, respectively, said lines of weakness defining with said longitudinal edges a first and a second longitudinal margin portion in each panel;

a first horizontal pattern of cohesive parallel and adjacent to said top edge on the face of said first panel;

a second horizontal pattern of cohesive parallel and adjacent to said bottom edge on the face of said second panel;

a first, second, third and fourth longitudinal pattern of cohesive;

each of said longitudinal patterns of cohesive being defined by individual configurations, each configuration having a first line AB having end points A and B and a second line CD parallel to said first line and having end points C and D, said lines are parallel to said longitudinal edges;

a third line BD having end points B and D which makes an angle ABD with said first line which is less than 90 degrees;

a fourth line AC having end points A and C;

a first longitudinal pattern of cohesive disposed in said first longitudinal margin portions on said face of said first panel;

a second longitudinal pattern of cohesive disposed in the first longitudinal margin portion in said second panel, said longitudinal pattern being a mirror image of the first longitudinal pattern such that when the first and second panels are folded about said fold line the individual configurations of said longitudinal patterns of cohesive conform and the first horizontal pattern of cohesive and the second horizontal pattern of cohesive conform;

the back of said second panel having a third longitudinal pattern of cohesive disposed in said first longitudinal margin portion;

the back of said third panel having a fourth longitudinal pattern of cohesive disposed in said first longitudinal margin portion;

said fourth longitudinal pattern of adhesive being a mirror image of the third longitudinal pattern of adhesive;

a third horizontal pattern of cohesive aligned parallel and adjacent to said top edge on said back of said second panel;

a fourth horizontal pattern of cohesive aligned parallel and adjacent to said bottom edge on said back of said third panel;

the back side of said third panel being folded about the second fold line whereby the back of said second and third panel are in contact such that the individual configurations of said third and fourth longitudinal patterns of cohesive conform and the third horizontal pattern of cohesive and the fourth horizontal pattern of cohesive conform.

9. A Z-fold pressure seal form as defined in claim 8 wherein fourth line AC and said third line BD are straight and are parallel.

10. A Z-fold pressure seal form as defined in claim 9 wherein the width of each longitudinal margin portion is about ⅜ inches and the length of said first line AC and said second line BD is about ⅜ inches.

11. A Z-fold pressure seal form as defined in claim 8, including:

a first horizontal line of weakness positioned parallel to but spaced from said top edge on face of said first panel;

said first horizontal pattern of cohesive being disposed between said top edge and said first horizontal line of weakness on said face of said first panel;

a second horizontal line of weakness positioned parallel to but spaced from said bottom edge of said face of said second panel;

said second horizontal pattern of cohesive being disposed between said bottom edge and said second horizontal line of weakness on said face of said first panel;

a third horizontal line of weakness positioned parallel to but spaced from said top edge on said back of said second panel;

said third horizontal pattern of cohesive being disposed between said top edge and said third horizontal line of weakness on the back of said second panel;

a fourth horizontal line of weakness positioned parallel to but spaced from said bottom edge the back of said third panel;

said fourth horizontal pattern of cohesive being disposed between said bottom edge and said fourth horizontal line of weakness.

12. A Z-fold pressure seal form as defined in claim 8 wherein said third longitudinal pattern of adhesive is substantially the same as said second longitudinal pattern of adhesive.

13. A C-fold pressure seal form, comprising:

a sheet having a face, a back, a first fold line, a first panel and a second panel separated by said fold line, a second fold line, and a third panel wherein said second panel and said third panel are separated by said second old line, each panel having a face, a back, a top edge, a bottom edge, a first side edge and a second side edge;

said sheet having first and second opposite longitudinal edges perpendicular to said first and second fold lines;

first and second longitudinal lines of weakness formed in said sheet parallel to and adjacent, but spaced from said first and second longitudinal edges, respectively, said lines of weakness defining with said longitudinal edges a first and a longitudinal margin portion in each panel;

a first horizontal pattern of cohesive parallel and adjacent to said top edge on the face of said first panel;

a second horizontal pattern of cohesive parallel and adjacent to said top edge on the back of said third panel;

a first, second, fifth, and sixth longitudinal pattern of cohesive;

each of said longitudinal patterns of cohesive having individual configurations, each configuration having a first line AB having end points A and B and a second line CD parallel to said first line and having end points C and D, said lines are parallel to said longitudinal edges;

a third line BD having end points B and D which makes an angle ABD with said first line which is less than 90 degrees;

a fourth line AC having end points A and C;

said first longitudinal pattern of cohesive disposed in said first longitudinal margin portions in said first panel;

said second longitudinal pattern of cohesive disposed in the first longitudinal margin portion on the face of said second panel;

said third panel having on its face a fifth longitudinal pattern of cohesive disposed in its first and second longitudinal margin portions, said fifth longitudinal pattern of cohesive being a mirror image of said second longitudinal pattern of cohesive;

said third panel having on its back a sixth longitudinal pattern of cohesive disposed in the first longitudinal margin portions;

said sixth longitudinal pattern of cohesive being similar to said first longitudinal pattern of cohesive disposed on the face of the first panel;

said second and third panels being folded about said second fold line such that the individual configurations of said fifth longitudinal pattern of cohesive and said second longitudinal patterns of cohesive conform;

said first and second panels being foldable about said first fold line such that the individual configurations of said first and said sixth longitudinal patterns of cohesive conform and said first and said second horizontal patterns of cohesive conform.

14. A pressure seal form as defined in claim 13 wherein fourth line AC and said third line BD are straight and are parallel.

15. A pressure seal form as defined in claim 14 wherein the width of each longitudinal margin portion is about ⅜ inches and the distance between said first line AB and second line CD is about ¼ inches.

16. A pressure seal form as defined in claim 15 wherein the length of first line AB and second line CD is about 3/16 inches and the length of third line BD and fourth line AC is about ⅜ inches.

17. A C-fold pressure seal form as defined in claim 13, including:

a first horizontal line of weakness positioned parallel to but spaced from said top edge on face of said first panel;

said first horizontal pattern of cohesive being disposed between said top edge and said first horizontal line of weakness on said face of said first panel;

a third horizontal line of weakness positioned parallel to but spaced from said top edge of said back of said third panel;

said second horizontal pattern of cohesive being disposed between said top edge and said third horizontal line of weakness on said back of said third panel.

18. A C-fold pressure seal form as defined in claim 17, wherein said first and said second fold lines are lines of weakness.

19. A C-fold pressure seal form as defined in claim 18 wherein said lines of weakness are perforations.

20. A C-fold pressure seal form as defined in claim 13 wherein said fifth and said sixth longitudinal patterns of cohesive are substantially the same as said first longitudinal pattern of cohesive.

21. A pressure seal form as defined in claim 1, further including:

a third longitudinal pattern of cohesive disposed in said second longitudinal margin portion in said first panel;

a fourth longitudinal pattern of cohesive disposed in said second longitudinal margin portion in said second panel;

said third and fourth longitudinal patterns of adhesive having the same individual configurations as said first longitudinal pattern of adhesive; and said fourth longitudinal pattern of cohesive being a mirror image of the third longitudinal pattern such that when the first and second panels are folded about said fold line, the individual configurations of said third and fourth longitudinal patterns of cohesive conform.

22. A Z-fold pressure seal form as defined in claim 8, further including:

a fifth longitudinal pattern of cohesive disposed in the second longitudinal margin portion on said face of said first panel;

a sixth longitudinal pattern of cohesive disposed in the second longitudinal margin portion on said face of said second panel;

a seventh longitudinal pattern of cohesive disposed in the second longitudinal margin portion on said back of said second panel;

an eighth longitudinal pattern of cohesive disposed in the second longitudinal margin portion on said back of said third panel;

said fifth, sixth, seventh, and eighth longitudinal patterns of cohesive having the same individual configurations as said first longitudinal pattern of cohesive;

said sixth longitudinal pattern of cohesive being a mirror image of said fifth longitudinal pattern such that when said first and second panels are folded about said first fold line, the individual configurations of said longitudinal patterns of cohesive conform; and said eighth longitudinal pattern of cohesive being a mirror image of said seventh longitudinal pattern such that when said second and third panels are folded about said second fold line, the individual configurations of said longitudinal patterns of cohesive conform.

23. A pressure seal form as defined in claim 13, further including:

a third longitudinal pattern of cohesive disposed in said second longitudinal margin portion in said first panel;

a fourth longitudinal pattern of cohesive disposed in said second longitudinal margin portion in said second panel;

a seventh longitudinal pattern of cohesive disposed in said second longitudinal margin portion in said third panel;

an eighth longitudinal pattern of cohesive disposed in said second longituidinal margin portion in said back of said third panel;

said third, fourth, seventh and eighth longitudinal patterns of cohesive including the same individual configurations of cohesive as said first, second, fifth, and sixth longitudinal patterns of cohesive;

second seventh longitudinal pattern of cohesive being a mirror image of said fourth longitudinal pattern such that when the second and third panels are folded about said second fold line, the individual configurations of said third and seventh longitudinal patterns of cohesive conform;

said eighth longitudinal pattern of cohesive being oriented such that when said second and third panels are folded about said second fold line, said eighth longitudinal pattern of cohesive is a mirror image of said third longitudinal pattern of cohesive; and when said first and second panels are folded about said first fold line, said third longitudinal pattern of cohesive conforms to said eighth longitudinal pattern of cohesive.

* * * * *